US005333411A

United States Patent [19]

Tschirschwitz et al.

[11] Patent Number: 5,333,411

[45] Date of Patent: Aug. 2, 1994

[54] CABLE WINDOW WINDER, PARTICULARLY FOR INSTALLATION IN MOTOR VEHICLES

[75] Inventors: Herbert Tschirschwitz, Coburg; Wolfgang Jäger, Untersiemau, both of Fed. Rep. of Germany

[73] Assignee: Brose Fahrzeugteile GmbH & Co. KG, Coburg, Fed. Rep. of Germany

[21] Appl. No.: 996,910

[22] Filed: Dec. 28, 1992

[51] Int. Cl.[5] ..... E05F 11/48

[52] U.S. Cl. ..... 49/352; 49/360

[58] Field of Search ..... 49/352, 360

[56] References Cited

U.S. PATENT DOCUMENTS

| | | | |
|---|---|---|---|
| 5,033,233 | 7/1991 | Suzumura | 49/352 |
| 5,058,322 | 10/1991 | Sambor | 49/352 |
| 5,076,014 | 12/1991 | Cuyl | 49/352 X |
| 5,199,310 | 4/1993 | Yoshimura | 49/352 X |

FOREIGN PATENT DOCUMENTS

| | | |
|---|---|---|
| 3638059 | 5/1987 | Fed. Rep. of Germany . |
| 3615578 | 9/1987 | Fed. Rep. of Germany . |
| 3740579 | 7/1988 | Fed. Rep. of Germany . |

*Primary Examiner*—Philip C. Kannan

*Attorney, Agent, or Firm*—Nils H. Ljungman & Associates

[57] ABSTRACT

A cable window winder, particularly for installation in motor vehicles, which has at least one guide rail with a slide element guided therein and connectable with the window pane, at least one holding angle (3) connected to the guide rail and supporting at least one guide pulley (31), as well as fastening means (32) for fitting the cable window winder. According to the invention one of the fastening means (32) is mounted in the rotary axis of the guide pulley (31) and is connected directly to the metal vehicle plate.

19 Claims, 3 Drawing Sheets

CABLE WINDOW WINDER, PARTICULARLY FOR INSTALLATION IN MOTOR VEHICLES

BACKGROUND OF THE INVENTION

1. Field of the Invention

The invention relates to a cable window winder particularly for installation in vehicles. Such winding devices generally consist of at least one guide rail with a slide element guided therein and connectable with the window pane, at least two holding angles connected to the guide rail and each supporting a guide pulley, and a fastening device for fitting the cable window winder.

2. Background Information

Normally considerable cable forces arise at the guide pulleys of a cable window winder which can lead to considerable leverages or bending moments, depending on the position of the fastening points of the cable window winder relative to the bearing points of the guide pulleys.

From DE 36 15 578 C1 a device is known for raising and lowering a vehicle window which has four stationary guide pulleys embraced by a closed cable which passes through a motion drive and is connected to holders fixed on the window pane. The known device is mounted on a guide frame which supports all the components of the device and has guide stays connected by cross supports and provided with guide grooves for guiding the holders which are connected to the cable pulley.

This known device furthermore has two separate cable loops driven by a common drive wheel so that should one cable loop tear then the device can still be operated in an emergency by the other cable loop. A disadvantage here however is that the guide frame of this device needs to have large dimensions in order to be able to take up the cable forces which occur without premature signs of wear, particularly as a result of the considerably large distances between its fastening points and the bearing points of the guide pulleys. This results in the known device having a heavy inherent weight.

Furthermore it has been usual up until now to provide the fastening points of a cable window winder in the guide rails or on holding angles or base plates attached thereto wherein the holding angles also support the guide pulleys and are then mounted at the ends of the guide rails (cf: DE 36 38 059 C2, DE 37 40 579 A1).

The known devices however all require more or less large dimensions for the components used since the rotational axes of the guide pulleys are always mounted at a distance from the fastening points of the devices. Also the attachment of holding angles which serve only for fixing the cable window winder and are usually connected by welded connections with the guide rails, incurs high manufacturing expense with correspondingly high production costs.

OBJECT OF THE INVENTION

The object of the invention is to provide a cable window winder of the kind already mentioned whose inherent weight can be reduced by reducing the dimensions of the components used without losing stability or functional reliability whilst at the same time making the production more cost-effective.

SUMMARY OF THE INVENTION

This object is achieved according to the invention by a cable window winder in which the fastening devices are each mounted in the rotary axis of the guide pulley and are connected directly to the sheet metal vehicle plate.

With the cable window winder according to the invention the cable forces which occur are transferred over the shortest route to the metal plate of the vehicle. Through this optimized force flow it is possible to make the components used weaker and thus to reduce the weight without impairing the stability and functional reliability of the cable window winder according to the invention. Furthermore the cable window winder according to the invention requires no additional holding angles serving only to fix the cable window winder so that no additional welded connections arise and the manufacturing costs become correspondingly more favourable.

An advantageous design of the solution according to the invention consists in mounting the guide pulley on an axle bolt connected to the holding angle and having a bore, more particularly a central bore for holding the fastening means wherein the central bore aligns with a second bore formed inside the holding angle.

This design allows a simple quick and stable fixing of the cable window winder according to the invention on the inner sheet metal plate or other parts of the vehicle door or a side part of the vehicle.

A further advantageous design of the solution according to the invention exists where the axle bolt is multi-stepped and rivetted to the holding angle.

It is hereby possible to dispense with additional spacer elements for positioning the guide pulley on the axle bolt whereby a quick fitting of the guide pulley becomes possible. The rivet connection between the axle bolt and holding angle need therefore only be designed for fitting and not for the cable and shear forces which occur during operation since after the cable window winder according to the invention has been fixed these forces are absorbed in the first instance by the fastening means. The rivets used can thus be made from less strong and therefore cheaper material.

Another advantageous embodiment of the fixing of the cable window winder according to the invention is characterised in that the fastening means consists of a screw whose head can be sunk in a recess in the axle bolt.

Through this design the fixing according to the invention is particularly small in the area of the guide pulley so that the installation of the cable window winder in vehicles where space is normally restricted is not complicated by the fixing according to the invention.

Furthermore preferred embodiments of the invention are characterised in the sub-claims.

BRIEF DESCRIPTION OF THE DRAWING

Some embodiments of the invention will be explained in detail in the following with reference to the Figures in the drawings in which.

DESCRIPTION OF THE PREFERRED EMBODIMENTS

Figure 1:
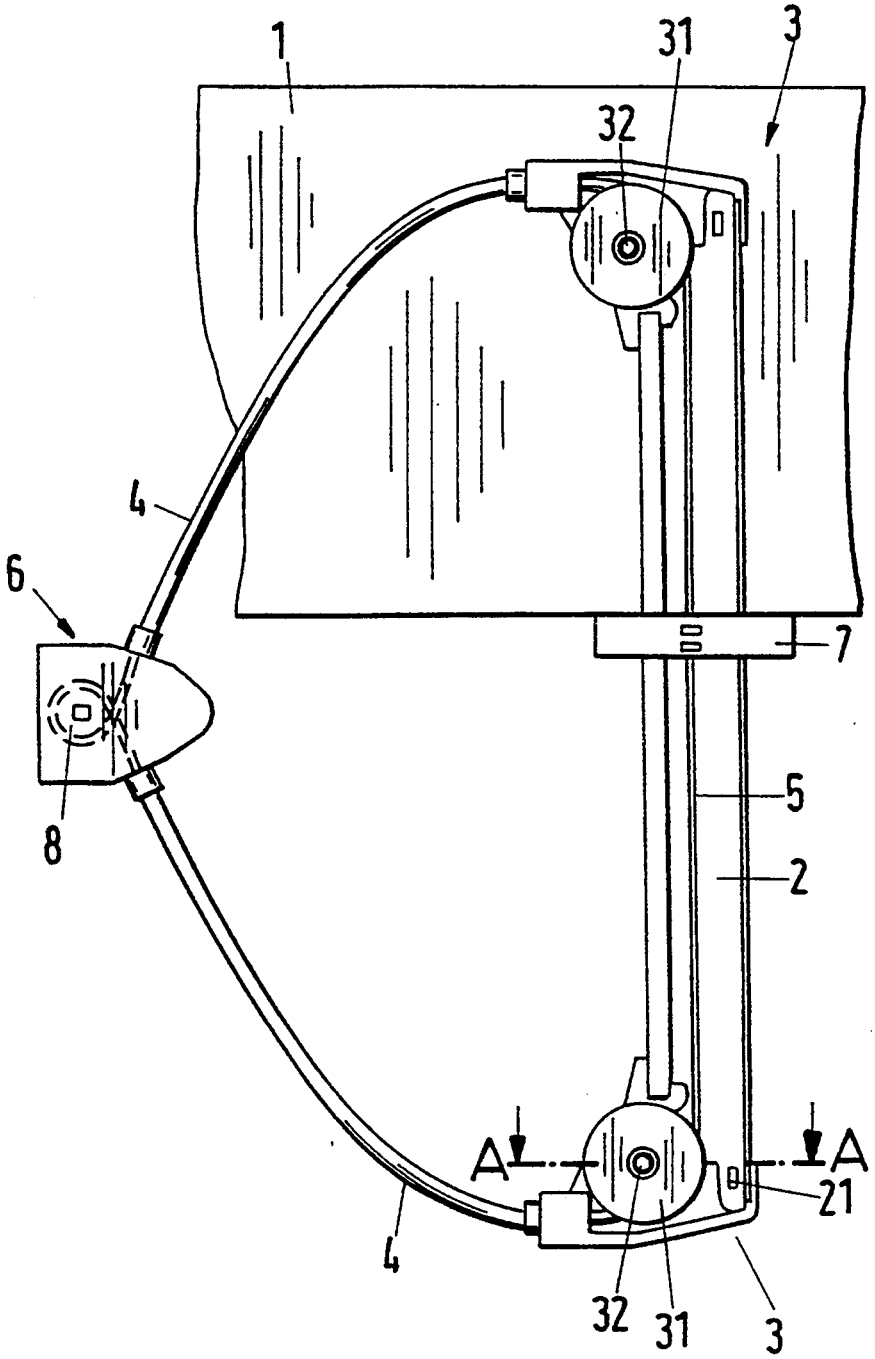
FIG. 1 is a side view of a cable window winder according to the invention with a guide rail and two guide pulleys.

FIG. 1 shows a cable window winder with a guide rail 2 wherein a holding angle 3 is fixed at each end. The ends of the guide rail 2 can be inserted into the holding angles 3 and are provided with detent openings 21 into which the detent elements formed on the holding angles 3 engage. On the guide rail 2 there is a slide element 7 displaceable along the guide rail and connected to the lower edge of a window pane 1.

The ends of a cable 5 are fixed to the slide element 7. The cable is directed on the holding angles 3 around guide pulleys 31 in Bowden sleeves 4. The Bowden sleeves 4 guide the cable 5 to a drive device 6 in which the cable 5 is wound with friction engagement around a hand- or motor-operated cable drum 8.

The illustrated cable window winder is connected directly to the inner metal plate of a vehicle door not shown in further detail, by means of fixing means 32 which are each mounted in the rotary axis of the guide pulleys 31.

Figure 2:
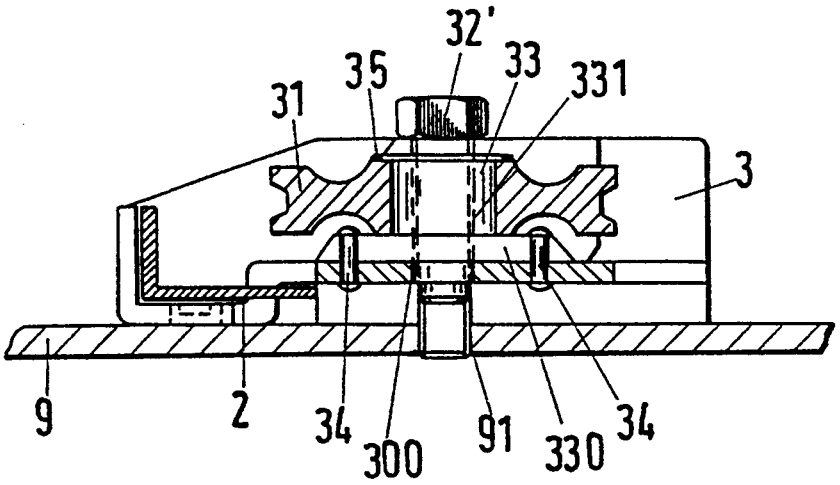
FIG. 2 is a sectional view through a holding angle supporting the guide pulley and connected to a coachwork plate.

FIG. 2 shows an enlarged sectional view of the holding angle 3 connected to the guide rail 2, along the sectional line A—A shown in FIG. 1.

In order to house the guide pulley 31 the holding angle 3 is fitted with a double-stepped axle bolt 33 whose larger step 330 adjoins the holding angle 3 and is connected to same by rivets 34. The larger step 330 of the axle bolt 33 furthermore serves as the axial bearing for the guide pulley 31 which is fixed axially at the other end of the axle bolt 33 by a security ring 35.

Furthermore a central bore 331 is formed in the axle bolt 33 and is brought to align with a further bore 300 formed in the holding angle 3. A screw 32' is pushed through the two bores 331, 300 and screwed into a threaded hole 91 of a metal coachwork plate 9 indicated wherein the upper end side of the axle bolt 33 serves as an abutment for the screw head.

Since after fixing the cable window winder on the vehicle plate 9 the screw connection substantially alone takes up the shear forces conditioned by the cable forces, the rivet connection between the axle bolt 33 and holding angle 3 need only be designed for the prefitting of the cable window winder.

Figure 3:
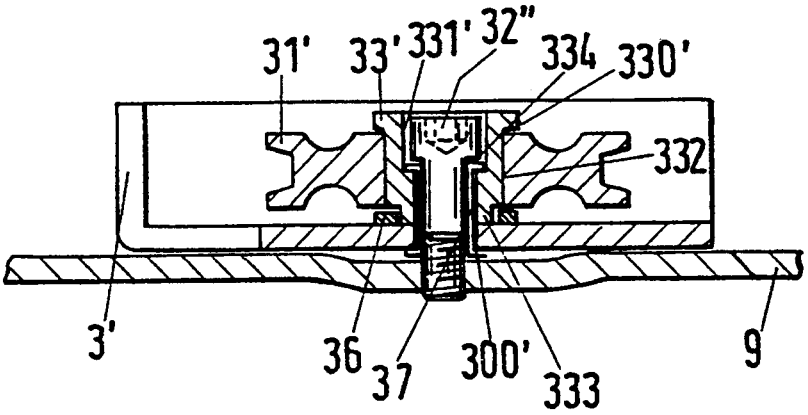
FIG. 3 is a sectional view of another holding angle with a triple-stepped axle bolt which is connected by a screw connection to a coachwork plate.

FIG. 3 shows a holding angle 3' which is different from FIGS. 1 and 2 and which has a triple-stepped axle bolt 33' for holding the guide pulley 31'.

The guide pulley 31' is mounted on the middle step 332 of the axle bolt 33' and is secured axially by the outer step 330' of the axle bolt and a distance ring 36 wherein the latter engages round the third and at the same time smallest step 333 of the axle bolt 33.

In the axle bolt 33' there is again a central bore 331' which is aligned with a second bore 300' cut out in the holding angle 3'. The central bore 331' is in this embodiment double-stepped wherein the axle bolt 33' and the holding angle 3' are connected by a tubular rivet 37 whose one end overlaps the inner recess of the double-stepped bore 331' of the axle bolt 33' whilst the other end of the tubular rivet 37 overlaps the underneath of the holding angle 3'.

An inner hexagonal screw 32" is pushed into the axle bolt 33'. The recess of the double-stepped bore 331' is thereby so deep that the screw head can be countersunk in the indentation 334. Through this design the holding angle 3' has overall a very small structural height.

Figure 4:
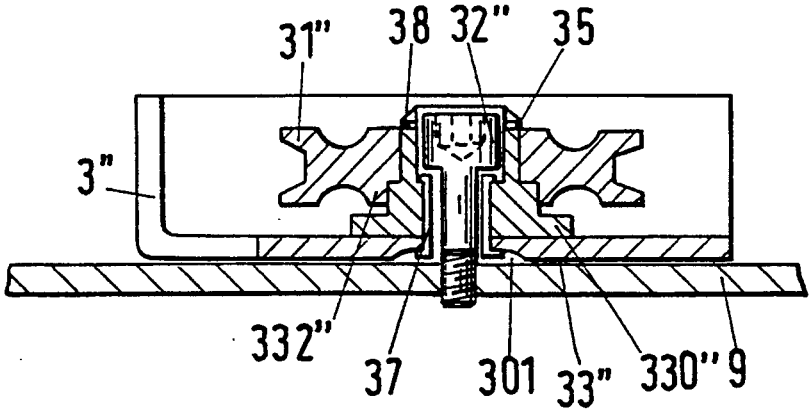
FIG. 4 is a sectional view of a further holding angle with a stepped bolt and guide pulley mounted thereon.

The holding angle 3" illustrated in FIG. 4 is likewise fitted with a triple-stepped axle bolt 33" which, as opposed to the previously described embodiment need not be separated from the holding angle 3" by loosening the inner hexagonal screw 32" and removing the tubular rivets 37 during a possible replacement of the guide pulley.

The triple-stepped axle bolt 33" lies in this case with the largest step 330" on the holding angle 3" wherein it is again connected to the holding angle 3" by a tubular rivet 37. On the underneath of the holding angle 3" an indentation 301 is formed so that the collar of the tubular rivet 37 is countersunk relative to the flat underneath of the holding angle.

The hub of the guide pulley 31" is designed with two steps wherein the inner hub recess is mounted axially on the centre step 332" of the axle bolt 33". Furthermore the axle bolt 33" is provided at the upper end with a ring groove 38 in which a security ring 35 is inserted which secures the guide pulley 31" against axial displacement and when changing the guide pulley 31" can be easily removed by means of expanding pliers.

Figure 5:
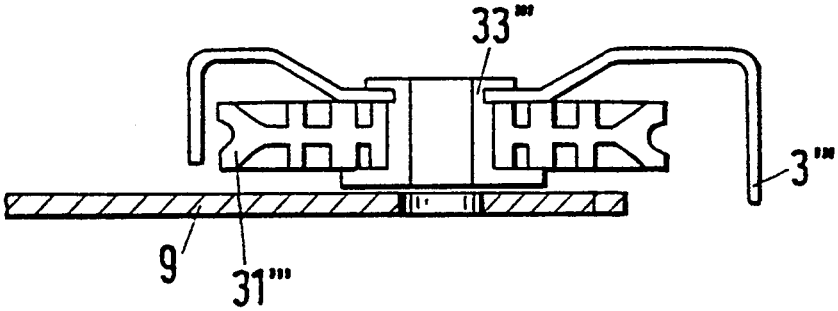
FIG. 5 is a sectional view of a holding angle with a stepped bolt which is connected to a coachwork plate.

The holding angle 3''' shown in FIG. 5 is provided with a stepped bolt 33''' which is connected at its end opposite the holding angle 3''' to the coachwork plate 9 and supports the guide pulley 31''' so that the holding angle 3''' covers the guide pulley 31'''.

The invention is not restricted in its design to the preferred embodiments given above. Rather a number of variations is possible which utilize the illustrated solution in quite different types of design. More particularly the solution according to the invention can even be used in those cable window winders which have two guide rails and more than two guide pulleys.

An example of a cable mechanism for raising and lowering windows of motor vehicles can be found in DE 41 31 100.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings, in their entirety, including all dimensions, proportions and/or shapes in at least one embodiment of the invention, are, if applicable, accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

We claim:

1. Cable window winder, particularly for installation in vehicle for raising and lowering a window pane of a vehicle, the vehicle having a vehicle body, the vehicle body comprising at least one sheet metal plate forming a part of the vehicle body, and said window winder consisting of:

at least one guide rail with a slide element guided therein and connectable with the window pane;

at least two holding angles connected to the guide rail and each supporting a guide pulley; and fastening means for fastening the cable window winder directly to the sheet metal vehicle plate, wherein the fastening means are each mounted in the rotary axis of the guide pulley and are configured to be connected directly to the sheet metal vehicle plate to mount the guide pulley directly to the sheet metal vehicle plate.

2. Cable window winder according to claim 1, wherein the guide pulleys are each mounted on an axle bolt connected to the holding angle and having a bore, preferably a central bore for holding the fastening means wherein the central bore is aligned with a second bore formed inside the holding angle (3).

3. Cable window winder according to claim 2 wherein:

the axle bolt is triple-stepped, and wherein a first outer step supports a spacer element adjoining the holding angle, a middle step serves to hold the guide pulley and a third outer step secures the guide pulley on the axle bolt in its axial direction; and the axle bolt is connected to the holding angle by means of a tubular rivet.

4. Cable window winder according to claim 2, wherein the axle bolt is multi-stepped and rivetted to the holding angle.

5. Cable window winder according to claim 4 wherein:

the axle bolt is triple-stepped, and wherein a first outer step supports a spacer element adjoining the holding angle, a middle step serves to hold the guide pulley and a third outer step secures the guide pulley on the axle bolt in its axial direction; and the axle bolt is connected to the holding angle by means of a tubular rivet.

6. Cable window winder according to claim 4 wherein the fastening means consist of a screw and that an indentation is formed in the axle bolt in which the head of the screw can be sunk.

7. Cable window winder according to claim 6 wherein the axle bolt is triple-stepped, and wherein a first outer step supports a spacer element adjoining the holding angle, a middle step serves to hold the guide pulley and a third outer step secures the guide pulley on the axle bolt in its axial direction.

8. Cable window winder according to claim 7 wherein the axle bolt is connected to the holding angle by means of a tubular rivet.

9. Cable window winder according to claim 2 wherein the fastening means consist of a screw and that an indentation is formed in the axle bolt in which the head of the screw can be sunk.

10. Cable window winder according to claim 9 wherein the axle bolt is triple-stepped, and wherein a first outer step supports a spacer element adjoining the holding angle, a middle step serves to hold the guide pulley and a third outer step secures the guide pulley on the axle bolt in its axial direction.

11. Cable window winder according to claim 10 wherein the axle bolt is connected to the holding angle by means of a tubular rivet (37).

12. Apparatus in a motor vehicle for moving a window between a first position and a second position, the motor vehicle having a support structure, and said apparatus comprising:

a first guide pulley and a second guide pulley, said first guide pulley and said second guide pulley each having an axis of rotation;

first bracket means and second bracket means, each of said first guide pulley and said second guide pulley being mounted on a corresponding one of said first bracket means and said second bracket means;

a guide rail disposed between and connecting said first bracket means and said second bracket means, said guide rail defining a path of travel between said first guide pulley and said second guide pulley;

drive means for moving the window between the first position and the second position along said path of travel;

cable means for being disposed about said first guide pulley and said second guide pulley and for connecting said drive means and said window;

means for attaching said cable means to said window, said means for attaching comprising a slide means for being guided along said guide rail along said first path of travel, said slide means comprising a carrier for carrying said window along said first path of travel to move said window between said first position and said second position upon movement of said slide along said first path of travel;

means for fastening each of said first guide pulley and said second guide pulley directly to said support structure of said motor vehicle, said means for fastening being disposed through said first guide pulley and said second guide pulley along said axis of rotation of each said guide pulley;

a first axle bolt and a second axle bolt, each of said first bracket means and said second bracket means having a corresponding one of said first axle bolt and said second axle bolt mounted thereon;

each said axle bolt having a longitudinal bore therein and an exterior circumferential surface disposed thereabout;

each said bracket means having an orifice therein, said orifice of said bracket means being aligned with said longitudinal bore of said corresponding axle bolt;

each of said first guide pulley and said second guide pulley being disposed about said exterior circumferential surface of a corresponding one of said first axle bolt and said second axle bolt of said corresponding bracket means; and said fastening means for being disposed through said longitudinal bore of each said corresponding axle bolt and through said orifice of said corresponding bracket means to fasten each said corresponding guide pulley, axle bore and bracket means directly to said support structure.

13. The apparatus according to claim 12, wherein:

each said axle bolt is fastened to its corresponding bracket means by rivet means;

said exterior circumferential surface of each said axle bolt comprising at least a first portion and a second portion, said first portion for being disposed adjacent said bracket means and said second portion for being disposed away from said bracket means;

said axle bolt having a first diameter at said first portion and a second diameter at said second portion, said first diameter being greater than said second diameter to form a first step;

said first portion being fastened to said bracket means by said rivet means; and each said guide pulley being disposed about said second portion of said exterior circumferential surface of said corresponding axle bore.

14. The apparatus according to claim 13, wherein:

said fastening means comprise screw means for being disposed through said longitudinal bore of said corresponding axle bolt and through said orifice of said corresponding bracket means;

said screw means for being threaded into said support structure to fasten said corresponding guide pulley, axle bolt and bracket means to said support structure;

said screw means having a head portion and a threaded portion, each of said threaded portion and said head portion having a diameter, and said diameter of said head portion being greater than said diameter of said threaded portion; and said longitudinal bore of each said axle bore having a first portion for passage of said threaded portion of said screw means therethrough and a recessed portion configured for receipt of the head portion of said screw means, each of said first portion of said longitudinal bore and said recessed portion having a diameter, said diameter of said recessed portion being greater than said diameter of said first portion of said longitudinal bore, and said diameter of said head portion of said screw means being greater than said diameter of said first portion of said longitudinal bore.

15. The apparatus according to claim 12, wherein:

said exterior circumferential surface comprises at least a first portion, a second portion, and a third portion;

said first portion for being disposed adjacent said bracket means and said third portion for being disposed away from said bracket means;

said second portion being disposed between said first portion and said third portion;

said first portion having a first diameter, said second portion having a second diameter, and said third portion having a third diameter, said second diameter being greater than said first diameter to define a first step and said third diameter being greater than said second diameter to define a second step;

said apparatus further comprises a spacing element for being disposed about said first portion between said first step and said bracket means;

said pulley for being disposed about said second portion between said spacing element and said second step; and said third portion for retaining said pulley on said axle bolt.

16. The apparatus according to claim 15, wherein:

said longitudinal bore has a first portion disposed adjacent said bracket means and a second portion disposed away from said bracket means, said first portion of said longitudinal bore defining a first internal diameter, said second portion of said longitudinal bore defining a second internal diameter, said second internal diameter being greater than said first internal diameter to form a third step;

said apparatus further comprises a tubular rivet for mounting said axle bolt to said bracket means, said tubular rivet being disposed through said longitudinal bore and through said orifice of said corresponding bracket means, said tubular rivet having a first end, a second end, and a central portion disposed between said first end and said second end, and said tubular rivet comprising:

a first flange at said first end, said first flange for engaging said third step in said longitudinal bore;

said central portion being configured for passing through said longitudinal bore and said orifice of said corresponding bracket means, said bracket means having a first surface disposed adjacent said axle bolt and a second surface, said second surface being disposed opposite to said first surface and away from said axle bolt, said second surface for being disposed adjacent said support structure; and a second flange at said second end for engaging said second surface of said bracket means to mount said axle bolt to said bracket means.

17. Apparatus in a motor vehicle for moving a window between a first position and a second position, the motor vehicle having a support structure, and said apparatus comprising:

a first guide pulley and a second guide pulley, said first guide pulley and said second guide pulley each having an axis of rotation, and said first guide pulley and said second guide pulley defining a path of travel therebetween;

drive means for moving the window between the first position and the second position;

cable means for being disposed about said first guide pulley and said second guide pulley and for connecting said drive means and said window;

means for attaching said cable means to said window, said means for attaching being disposed between said first guide pulley and said second guide pulley for movement of said means for attaching along said path of travel to move said window between said first position and said second position by said drive means;

means for fastening each of said first guide pulley and said second guide pulley directly to said support structure of said motor vehicle, and means for fastening being disposed through said first guide pulley and said second guide pulley along said axis of rotation of each said first guide pulley and said second guide pulley to attach said first guide pulley and said second guide pulley directly to said support structure;

first bracket means and second bracket means;

each of said first bracket means and said second bracket means having a corresponding orifice therethrough for passage of said fastening means therethrough;

said fastening means comprising:

first fastening means for being disposed through said first guide pulley and said corresponding orifice of said first bracket means to simultaneously fasten said first guide pulley and said first bracket means directly to said support structure; and second fastening means for being disposed through said second guide pulley and said corresponding orifice of said second bracket means to simultaneously fasten said second guide pulley and said second bracket means directly to said support structure.

18. The apparatus according to claim 17, wherein said first and second fastening means comprise first and second axle bolts.

19. The apparatus according to claim 18, wherein:

said apparatus further comprises a guide rail disposed between and connecting said first bracket means and second bracket means, said guide rail defining said first path of travel; and said means for attaching comprises a slide means for being guided along said guide rail along said first path of travel, said slide means comprising a carrier for carrying said window along said first path of travel to move said window between said first position and said second position upon movement of said slide along said first path of travel.

* * * * *